US007210175B2

(12) United States Patent
Chiang

(10) Patent No.: US 7,210,175 B2
(45) Date of Patent: May 1, 2007

(54) SWIMMING GOGGLES

(76) Inventor: Herman Chiang, 11F-2 No. 634-9 Ching-Ping Rd., Chung-Ho City, Taipei Hsien (TW)

( * ) Notice: Subject to any disclaimer, the term of this patent is extended or adjusted under 35 U.S.C. 154(b) by 206 days.

(21) Appl. No.: 11/092,927

(22) Filed: Mar. 30, 2005

(65) Prior Publication Data

US 2006/0218704 A1 Oct. 5, 2006

(51) Int. Cl.
*A61F 9/02* (2006.01)

(52) U.S. Cl. ..... 2/450

(58) Field of Classification Search ..... 2/426, 2/428, 440, 442, 445, 448, 450; 351/43
See application file for complete search history.

(56) References Cited

U.S. PATENT DOCUMENTS 6,349,419 B1 * 2/2002 Chiang ..... 2/428
6,349,420 B1 * 2/2002 Chiang ..... 2/428
6,832,394 B1 * 12/2004 Chiang ..... 2/428
7,007,311 B2 * 3/2006 Chiang ..... 2/448
7,020,905 B2 * 4/2006 Chiang ..... 2/448
7,055,182 B2 * 6/2006 Chiang ..... 2/450
7,146,654 B2 * 12/2006 Chiang ..... 2/428

* cited by examiner

*Primary Examiner*—Katherine Moran
(74) *Attorney, Agent, or Firm*—Troxell Law Office, PLLC

(57) ABSTRACT

A pair of swimming goggles includes two reticulate clipping frames which are connected through a bridge and have an assembling opening respectively, two glass frames which are assembled in the clipping frames respectively and are made of soft material for receiving an eyeglass respectively, and two fasteners for closing the assembling opening of the clipping frame and providing extension of a strip. Two snapping rings are formed at the clipping frame for engaging the front and rear side edges of the glass frame. A plurality of ribs is connected between the snapping rings. A plurality of positioning grooves is defined at the outer surface of the glass frame corresponding to the ribs of the clipping frame. Two clipping grooves are respectively defined in the side edges of the glass frame corresponding to the snapping rings. Therefore, the weight of the pair of swimming goggles is reduced thereby providing light and comfortable wearing.

10 Claims, 3 Drawing Sheets

SWIMMING GOGGLES

FIELD OF THE INVENTION

The present invention relates to a pair of swimming goggles, and particularly to a pair of swimming goggles comprising glass frames made of flexible material, wherein eyeglasses received therein and through reticulate clipping frames and fasteners to assembled together.

BACKGROUND OF THE INVENTION

Formations of swimming goggles are various but are generally classified as three types in accordance with means of assembling eyeglasses, that is, an integral formation in which the eyeglass is integral with a glass frame, an embedding formation in which the eyeglass is integrally embedded in the glass frame, and an assembling formation in which the eyeglass is assembled to a veil-shaped protection pad and then is assembled to the glass frame and fixed by a fastener. However, in the above formations of the conventional swimming goggles, the glass frame is made of rigid material. Since the glass frame is a main body of a pair of swimming goggles and takes up almost half weight of the pair of swimming goggles, the weight of the pair of swimming goggles is hard to reduce and so cannot provide light and comfortable wearing.

SUMMARY OF THE INVENTION

Accordingly, an object of the present invention is to provide a pair of swimming goggles with two glass frames made of flexible material and two clipping frames made of light material for reducing weight of swimming goggles thereby providing light and comfortable wearing.

To achieve the above object, a pair of swimming goggles includes:

two reticulate clipping frames each having two snapping rings with a plurality of ribs connected therebetween, an assembling opening being defined in the outer side of the snapping ring, first and second connecting plates extending from the assembling opening and being connectable together;

a bridge connected between the clipping frames;

two glass frames made of flexible material and assembled in the clipping frame respectively, each glass frame having an outer surface and an inner surface, a receiving groove being defined in the inner surface, a plurality of positioning grooves is defined in the outer surface corresponding to the ribs of the clipping frame, two clipping grooves being defined in the glass frame corresponding to the snapping rings;

two eyeglasses received in the receiving grooves of the glass frames respectively; and two fasteners assembled in the first and the second connecting plates of the clipping frame and at least including first and second covers which are engageable and provide connection with a strip.

Other objects, advantages and novel features of the present invention will be drawn from the following detailed embodiment of the present invention with attached drawings, in which:

DESCRIPTION OF THE PREFERRED EMBODIMENT

Figure 1:
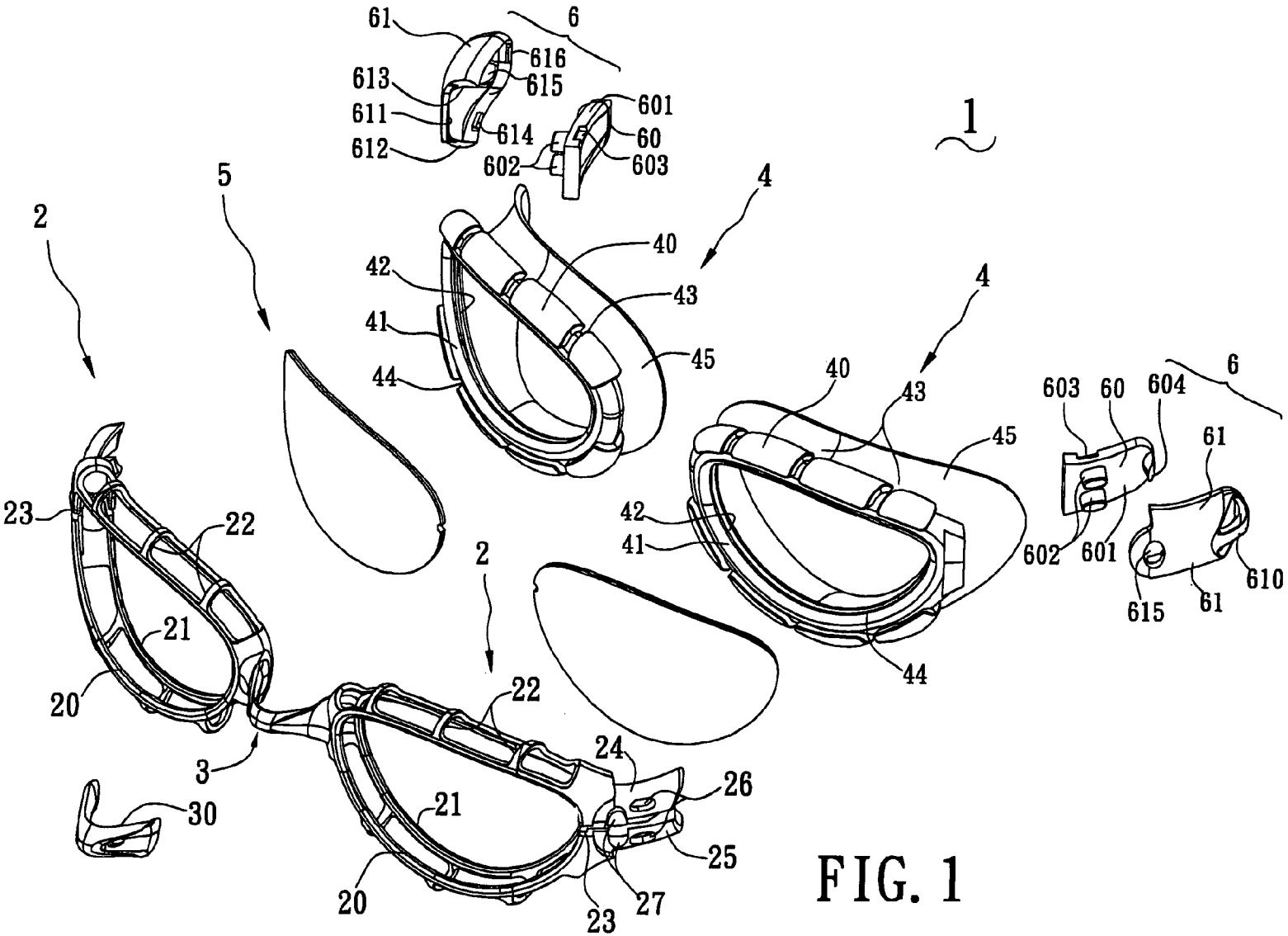
FIG. 1 is a perspective exploded view of a pair of swimming goggles of the present invention.
Figure 2:
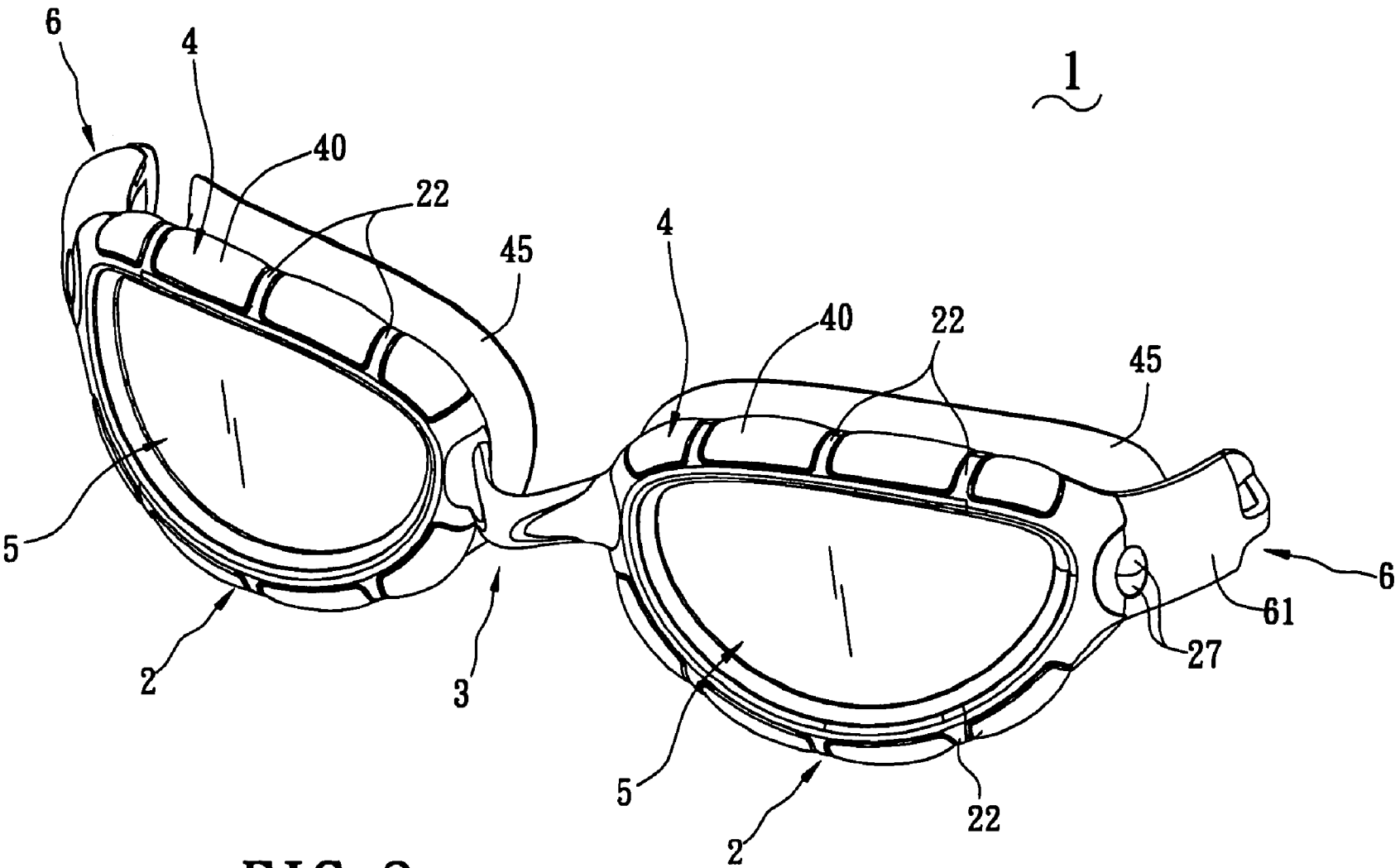
FIG. 2 is an assembled view of FIG. 1.

Referring to FIG. 1, a pair of swimming goggles 1 includes two reticulate clipping frames 2, a bridge 3, two glass frames 4, two eyeglasses 5 and two fasteners 6. Each clipping frame 2 is formed with two snapping rings 20, 21. A plurality of ribs 22 is connected between the snapping rings 20, 21. The distance between the snapping rings 20, 21 is less than the length of the rib 22. The ribs 22 are evenly spaced and parallel. An assembling opening 23 is respectively defined at the outer sides of the snapping rings 20, 21. First and second connecting plates 24, 25 extend from the assembling openings 23 and are connectable together. Each connecting plate 24, 25 is defined with a first connecting member 26 which is an elongate hole, and a second connecting member 27 which is a semi-cylinder. When the first and the second connecting plates 24, 25 are closed together, the second connecting members 27 are combined to be a cylinder. The bridge 3 is connected between the clipping frames 2 and is integral with the clipping frames 2. A flexible pad 30 is integrally formed at the bridge 3 for providing comfortable accommodation to a nose.

Each glass frame 4 is made of flexible material and is assembled in the corresponding clipping frame 2. Each glass frame 4 has an outer surface 40 and an inner surface 41. A receiving groove 42 is defined in the inner surface 41 for receiving the eyeglass 5. A plurality of positioning grooves 43 is defined in the outer surface 41 corresponding to the ribs 22 of the clipping frame 2. Two clipping grooves 44 are defined in the side edge of the glass frame 4 corresponding to the snapping rings 20, 21. A protection pad 45 integrally extends from a side of the inner surface 41 for providing comfortable contact with a face.

The fastener 6 is assembled in the first and the second connecting plates 24, 25 of the clipping frame 2 thereby fixing the first and the second connecting plates 24, 25 together. Each fastener 6 includes a first cover 60 and a second cover 61 matable with the first cover 60. The first cover 60 has a bottom surface 601 with a first jointing member 602 which is an elongate cylinder for connecting with the first connecting member 26. A first engaging member 603 which is a recess is defined in opposite sides of the first cover 60 respectively. The second cover 61 has a bottom surface 611 and two side surfaces 612, 613. The bottom surface 611 is disposed with a strip seat 610 for connecting with a strip (not shown). A second engaging member 614 is respectively defined in the side surfaces 612, 613 corresponding to the first engaging member 603 and is a protrusion for engaging with the first engaging member 603 thereby combining the first and the second covers 60, 61. A second jointing member 615 is formed at the bottom surface 611 corresponding to the second connecting member 27 (semi-cylinder) and is a circular hole for receiving the second connecting members 27 when the first and the second connecting plates 24, 25 connect together. A barb 604 and a mating groove 616 matable to the clip 604 are respectively disposed at the front edges of the bottom surfaces 601, 611 of the first and the second covers 60, 61.

Figure 4:
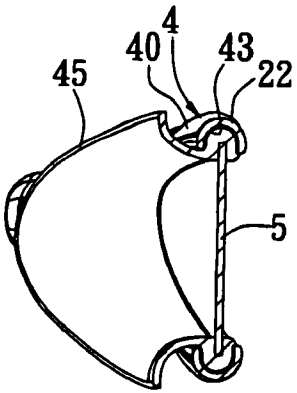
FIG. 4 is a cross-sectional view of FIG. 3 along line 4—4.
Figure 3:
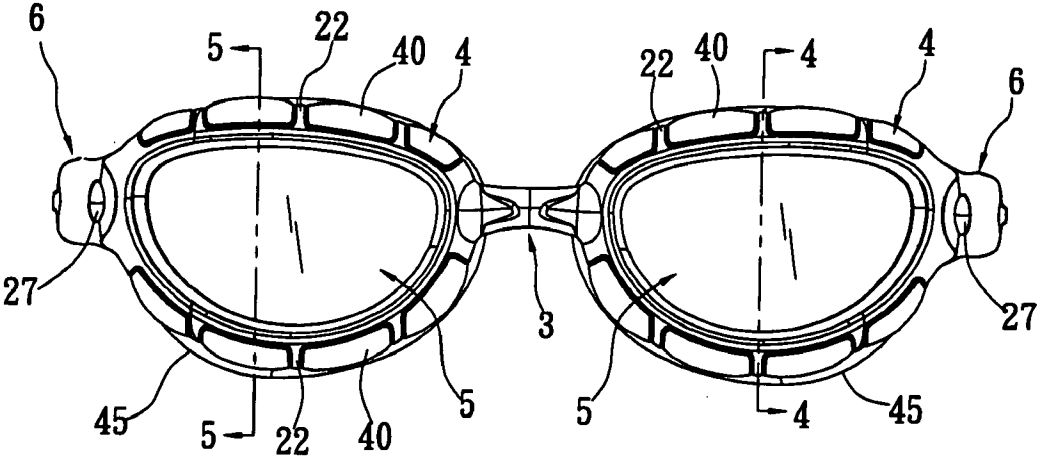
FIG. 3 is a front elevational view of FIG. 2.
Figure 5:
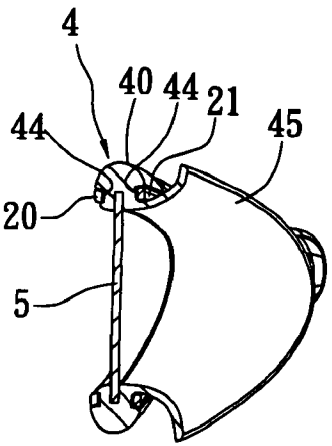
FIG. 5 is a cross-sectional view of FIG. 3 along line 5—5.

In assembly, the eyeglasses 5 are respectively received in the receiving grooves 42 of the glass frames 4. The glass frame 4 extends from the assembling opening 23 of the clipping frame 2 to the side of the clipping frame 2 connecting the bridge 3 thereby being received in the clipping frame 2. Also referring to FIGS. 3–5, the ribs 22 of the clipping frame 2 are received in the positioning grooves 43 through the circular outer surface 40 of the glass frame 4 (see FIG. 4). The snapping rings 20, 21 of the clipping frame 2 are received in the clipping grooves 44 of the glass frame 4 (see FIG. 5) thereby effectively securing the glass frame 4.The first jointing member 602 (elongate cylinder) of the first cover 60 is received in the first connecting member 26 (elongate hole) of the first and the second connecting plates 24, 25 thereby connecting the first and the second connecting plates 24, 25 together. The second connecting members 27 (semi-cylinder) are combined to be a cylinder and are received in the second jointing member 615 (circular hole) of the second cover 61. The first engaging member 603 (recess) of the first cover 60 is engaged with the second engaging member 614 (protrusion) of the second cover 61.The clip 604 is engaged with the mating groove 616 of the bottom surfaces 601, 611. Therefore, the assembling opening 23 of the clipping frame 2 is closed thereby securely fixing the glass frame 4 and the eyeglass 5. Thus, the glass frame 4 of the present invention is made of flexible material and the clipping frame 2 is made of light material for reducing weight of the pair of swimming goggles thereby providing light and comfortable wearing.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A pair of swimming goggles comprising two reticulate clipping frames each having two snapping rings with a plurality of ribs connected therebetween, an assembling opening being defined in the outer side of the snapping ring, first and second connecting plates extending from the assembling opening and being connectable together;

a bridge connected between the clipping frames;

two glass frames made of flexible material and assembled in the clipping frames respectively, wherein each glass frame having an outer surface and an inner surface, a receiving groove being defined in the inner surface, a plurality of positioning grooves is defined in the outer surface corresponding to the ribs of the clipping frame, two clipping grooves being defined in the glass frame corresponding to the snapping rings;

two eyeglasses received in the receiving grooves of the glass frames respectively; and two fasteners assembled in the first and the second connecting plates of the clipping frames and at least including first and second covers which are engageable and provide connection with a strip.

2. The pair of swimming goggles as claimed in claim 1, wherein the distance between the snapping rings of the clipping frame is less than the length of the rib.

3. The pair of swimming goggles as claimed in claim 2, wherein the ribs of the clipping frame are evenly spaced and parallel.

4. The pair of swimming goggles as claimed in claim 3, wherein the bridge is integral with the clipping frames and has a flexible pad.

5. The pair of swimming goggles as claimed in claim 1, wherein a protection pad integrally extends from the inner surface of the glass frame.

6. The pair of swimming goggles as claimed in claim 5, wherein a first connecting member and a second connecting member is respectively formed at the first and the second connecting plates, the first connecting member is an elongate hole and the second connecting member is a semi-cylinder which is respectively formed at an edge of a connecting surface of each of the first and the second connecting plates, when the first and the second connecting plates are connected together, the second connecting members are combined to be a cylinder.

7. The pair of swimming goggles as claimed in claim 6, wherein the first cover has a bottom surface with a first jointing member formed thereon for connecting with the first connecting member, the first jointing member is an elongate cylinder.

8. The pair of swimming goggles as claimed in claim 7, wherein the second cover has a bottom surface and two side surfaces, a second jointing member is defined in the bottom surface corresponding to the second connecting member, the second jointing member is a circular hole, a strip seat is defined at the second cover opposite the second jointing member.

9. The pair of swimming goggles as claimed in claim 6, further comprising a first engaging member and a second engaging member, the first engaging member is defined in a bottom surface of the first cover and is a recess, the second engaging member is formed at the second cover and is a protrusion.

10. The pair of swimming goggles as claimed in claim 9, wherein the bottom surfaces of the first and the second covers respectively have a barb and a mating groove matable with the clip.

* * * * *